United States Patent [19]

Stokkers

[11] 4,296,863

[45] Oct. 27, 1981

[54] LIDDED CONTAINER STRUCTURE AND PACKAGE STRUCTURE FOR SAME

[75] Inventor: Henk Stokkers, Groenlo, Netherlands

[73] Assignee: Maryland Cup Corporation, Owings Mills, Md.

[21] Appl. No.: 104,821

[22] Filed: Dec. 18, 1979

Related U.S. Application Data

[62] Division of Ser. No. 900,743, Apr. 27, 1978, Pat. No. 4,195,465.

[51] Int. Cl.[3] ..... B65D 21/02; B65D 85/62

[52] U.S. Cl. ..... 206/504; 206/526; 220/306; 229/43

[58] Field of Search ..... 206/526, 504; 229/43; 220/1 R, 307, 306, 352

[56] References Cited

U.S. PATENT DOCUMENTS

| | | | |
|---|---|---|---|
| Re. 18,942 | 9/1933 | Morris | 206/504 |
| 1,794,285 | 2/1931 | Foster | 220/1 R |
| 1,892,531 | 12/1932 | McKee | 220/1 R |
| 2,812,121 | 11/1957 | Sheets | 220/306 |
| 2,941,562 | 6/1960 | Ripin | 220/352 |
| 3,055,540 | 9/1962 | Ringlen | 220/307 |
| 3,081,904 | 3/1963 | Pipes | 220/306 |

*Primary Examiner*—William T. Dixson, Jr.

*Attorney, Agent, or Firm*—Birch, Stewart, Kolasch & Birch

[57] ABSTRACT

Containers such as those used for food stuffs having a generally frusto-conical initial shape are constrained into a forming die during the handling of the containers for injecting quantities of edibles and the like therein such that the containers are constrained to enter a die having a generally square configuration and then, while still in the die, the containers are filled with food or other material and a square lid is fed into position above the filled container and placed thereon to maintain the square configuration of the upper end thereof. The resulting containers provide a much more efficient packaging for equal volumes of product when compared with the more conventional frusto-conical shape containers. The invention is particularly well-adapted to packaging ice cream and the like.

3 Claims, 16 Drawing Figures

FRUSTO CONICAL

VOLUME = 7.6 dm x 3.04 dm x 0.89 dm = 20.56 $dm^3$

SQUARE - ROUND

VOLUME = 6.85 dm x 2.74 dm x 0.82 dm = 15.39 $dm^3$

LIDDED CONTAINER STRUCTURE AND PACKAGE STRUCTURE FOR SAME

This application is a divisional, of copending application Ser. No. 900,743, filed on Apr. 27, 1978, now U.S. Pat. No. 4,195,465.

FIELD OF THE INVENTION

This invention relates to open-mouthed containers combined with a lid subsequent to the filling of the container and more particularly, to a frusto-conical basic container which has been formed after initial fabrication to receive a square lid during the filling and handling process.

BACKGROUND OF THE INVENTION

In the marketing of frozen confections or perishable food products which must be refrigerated and/or maintained in a frozen state, the most desirable form of individual packages are those which can occupy only a minimum amount of volume in a given freezer or refrigeration compartment such that the customers purchasing such items in bulk for resale at the retail level will have their storage facilities utilized in the most efficient manner. This saves both space and energy for maintaining a given large bulk volume of food stuffs or other perishables at a desirable temperature level or other environmental parameter which is to be controlled.

Present day container shapes which are the most common are frusto-conical containers on which round lids or generally shallow cylindrical caps are placed.

An optimum consideration in the fabrication of a more efficiently packaged container would be in the ability to manufacture the containers, initially, in the old configuration and somehow efficiently and inexpensively convert these to a more efficient packaging shape such that a given volume of material, for example, ten liters of ice cream, could be packaged in a much lesser volume than with either of the more conventional shaped containers.

It is therefore, an object of this invention to provide a new and novel container shape for packaging perishables and the like.

Still another object of the present invention is to provide a new and novel container shape for the efficient packaging of perishables which will not only reduce the ultimate volume of a bulk package but will provide means by which the containers can be manufactured by presently used conventional means and subsequently, during the filling and closing process, be converted to the newly shaped configuration desired.

Still another object of the present invention is to provide a method for manufacturing a more efficient bulk packaging container shape for food stuffs and the like.

Yet another object of the present invention is to provide a new and novel apparatus for converting conventionally shaped frusto-conical containers into a container having a square open top configuration and a round bottom with a square lid placed on the square open top configuration when the container is in a loaded condition, to thereby retain the desired shape thereof.

These and other objects of the present invention will become more fully apparent with reference to the following specification and drawings which relate to a preferred embodiment of the present invention.

SUMMARY OF THE INVENTION

A basically frusto-conical open mouth container is initially manufactured which has a circular sectional view and is transferred into a receiving slot and die mechanism into which the container is constrained to thereby assume a square shape in its uppermost region adjacent the top curl or upper lip thereof. Subsequently, the container in the die is moved to a filling station wherein a given quantity of food stuff or the like is discharged into the container. Next, the container travels to a square lid discharging device wherein the container picks up the lid which is then forced onto the filled container while still in the die mechanism to thereby provide a means for retaining the constrained square configuration of the uppermost portion thereof and at the same time close the container. At a final work station the container is ejected both vertically and horizontally onto a suitable conveyor means or the like whereupon it is conveyed to a refrigeration or freezing chamber.

Furthermore, these containers are then packaged in bulk packages containing, for example, ten one-liter packages in a ten-liter bulk package. The resultant space savings in the bulk packages are on the order of 25% over conventional frusto-conical packages holding the same quantity of ice cream. Despite the initial container shape, the ultimate shape is a square top container with a round bottom and this can be achieved without fabricating the cups or containers in any different manner, initially, than has been done for many years.

Accordingly, the present invention provides a method, apparatus and container for optimizing the space occupied by a given quantity of packaged food products such that the manufacturer of the cups or containers is not required to change in its container manufacturing methods and equipment, since only during the filling and closing process is the optimum container shape assumed.

DETAILED DESCRIPTION OF THE DRAWINGS

Referring first to FIGS. 1, 2, 3A and 3B of the drawings, the space-saving feature of the square-round container of the present invention when placed in bulk packages of an equal number of equal capacity containers becomes readily apparent.

Figure 1:
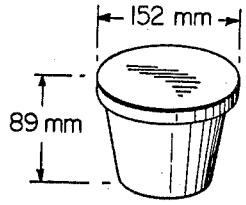
FIG. 1 is a perspective view of a conventional frusto-conical open-mouthed container with a round or shallow or cylindrical lid thereon.
Figure 2:
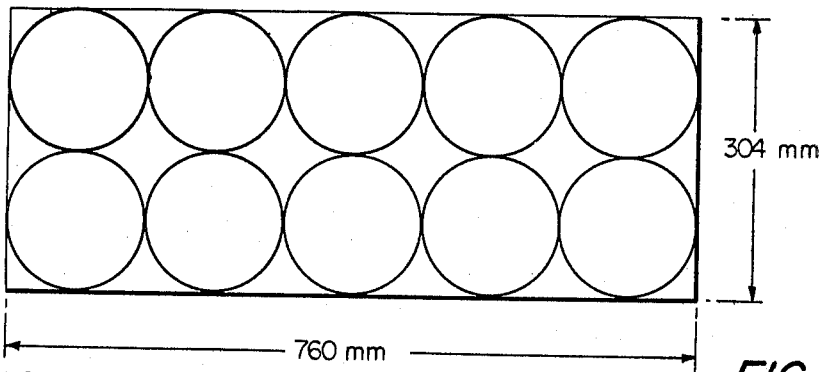
FIG. 2 is a top plan view of a plurality of the containers of FIG. 1 contained in a bulk package of ten such containers.

For example, the frusto-conical container of FIG. 1 which is 89 mm in height 152 mm in its largest diameter and having a capacity of one liter, when placed in a bulk package containing ten such containers results as shown in FIG. 2, in a bulk package having outside dimensions of 7.6 dm by 3.04 dm by 0.89 dm. This package, accordingly, has a resulting volume of 20.56 cubic decimeters.

Figure 3A:
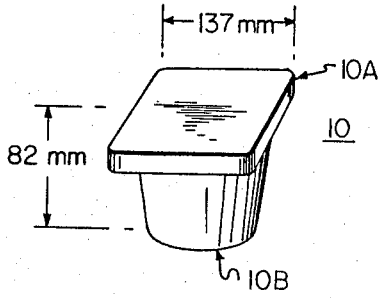
FIG. 3A is a perspective view of a square-topped round-bottomed container of the present invention with a square lid configuration thereon.
Figure 3B:
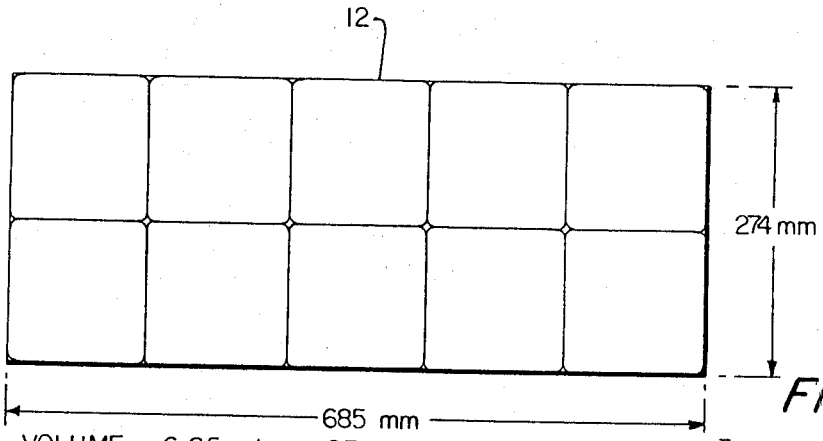
FIG. 3B is a top plan view of a bulk package of ten of the containers of FIG. 3A.

Referring now to FIGS. 3A and 3B, a container 10 of the present invention is shown as having a square configured upper portion which is defined by a lid in FIG. 3A and a round bottom portion 10B in which, an 82 mm depth is combined with a 137 mm side length of the square formed top of the container such that the resulting bulk package 12 of one-liter capacity holding ten such containers is dimensioned as follows: 6.85 dm by 2.74 dm by 0.82 dm for a total volume of 15.39 cubic decimeters.

Thus, it is readily seen that approximately a 25% volume reduction is achieved over the conventional frusto-conical type containers and packages of FIGS. 1 and 2.

The container 10 of the present invention as illustrated in FIG. 3A has a further desirable feature, namely, it is manufactured in an identical manner to the container of FIG. 1, therefore, requiring no modification of equipment by the manufacturer of such containers and instead, pursuant to the present invention, as will be more fully described hereinafter, the container is formed with its square uppermost portion during the filling, closing and handling steps wherein food products, ice cream, or the like are loaded into the containers.

Figure 4A:
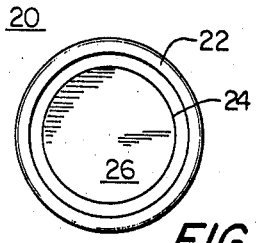
FIG. 4A is a top plan view of a typical frusto-conical open-topped container utilized in the present invention.
Figure 4C:
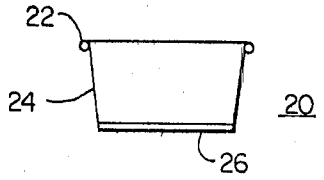
FIG. 4C is a schematic cross-sectional illustration of a conventional frusto-conical open-topped container similar to that illustrated in FIGS. 4A and 4B.
Figure 4B:
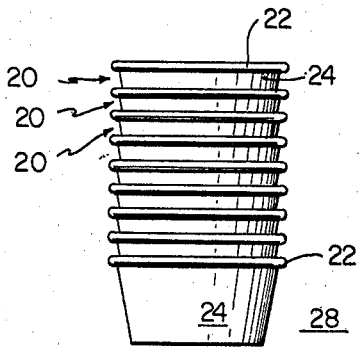
FIG. 4B is a side elevation of a stack of containers such as those illustrated in FIG. 4A.

Referring now to FIGS. 4–8, and with particular initial reference to FIGS. 4A, 4B and 4C, a frusto-conical container 20 is illustrated as having a top curl 22, a side wall portion 24 of frusto-conical configuration and a bottom portion 26 of a suitable conventional configuration. A plurality of such containers 20 are shown in a stack 28 in FIG. 4B in which they are vertically nested one within the other and in FIG. 4C, the container 20 is shown in schematic cross-section to further illustrate the configuration of a conventional top curl 22, frusto-conical side wall 24 and bottom web portion 26. The bottom web portion at 26 is raised slightly above the lowermost portion of the frusto-conical side wall 24 in the particular container configuration shown but can be substantially flush with the bottommost portion of the side wall 24 depending upon the desired bottom curl or seam configuration utilized by the particular container manufacturer. Likewise, various embodiments of conventional top curls such as an inturn curl, a high-rise curl or the more conventional rolled top curl shown in FIG. 4C can be utilized.

Figure 4D:
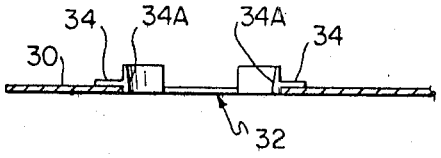
FIG. 4D is a cross-sectional view taken along line 4D—4D of FIG. 4E.
Figure 4E:
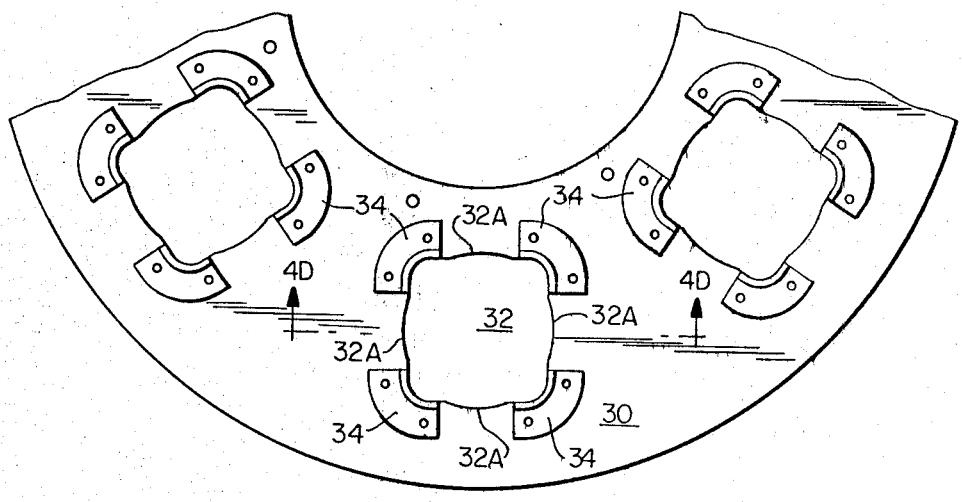
FIG. 4E is a top plan view of a die orifice and container holding segment from a filling machine utilized with the present invention.

FIGS. 4D and 4E illustrate a segment or insertable plate section 30 of the type generally illustrated in U.S. Pat. No. 3,225,889 to John B. West, issued Dec. 28, 1965 for a "Machine for Packaging Food Products" which is the type of equipment with which the present invention is contemplated for use in forming and filling the square-round containers of this invention. Therefore, the disclosure of this patent to John B. West is incorporated by reference herein.

The segmental plate 30 forms a portion of a rotary dial which includes a multiplicity of the plate 30 arranged in a circle around a central drive means or shaft such that the plates 30 may be indexed from one work station to another under the control of the master machine in a manner fully illustrated in the above-referenced patent to West.

Figure 5A:
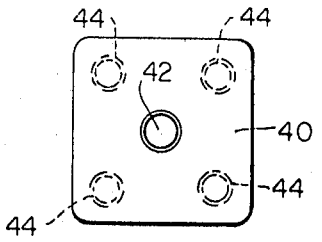
FIG. 5A is a top plan view of a pusher assembly utilized to form the square-round container of the present invention in conjunction with the die orifice illustrated in FIGS. 4D and 4E.
Figure 5B:
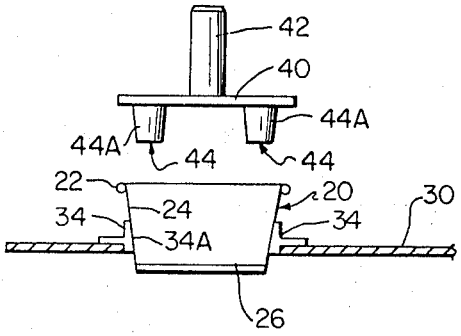
FIG. 5B illustrates the pusher assembly, conventional container and die orifice in schematic functional interrelationship.

Centrally located in the segmental plate 30 is a substantially square opening 32 defined therein which opening has scalloped edges centrally of the corners of the square opening such as illustrated at 32A with the corners of the square opening being defined by arcuate bosses or die inserts 34, which are riveted or otherwise suitably fastened to the surface of the plate 30, the said die inserts having interior surfaces 34A which are tapered conformally with the side wall 24 of a container 20 to be ultimately forced into the square opening 32 and held therein by means of the said bosses 34 as generally illustrated in FIG. 5B, to be hereinafter more fully described.

Figure 6A:
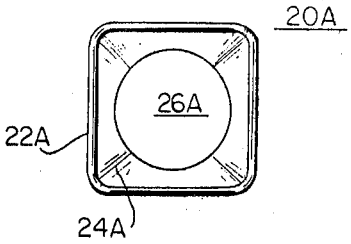
FIG. 6A illustrates a top plan view of a square-round container of the present invention as formed by the method and apparatus of the present invention.

Referring now to FIGS. 5A and 5B, a square pusher or plunger 40 is illustrated as having a drive rod or push rod 42 centrally located on the upper surface thereof and four dependent frusto-conical male forming members 44 extending downward from the lower surface thereof in registry with the four bosses 34 such that the frusto-conical taper of the side wall portions 44A of the dependent male forming members 44 are conformal with the interior surfaces 34A of the bosses 34 such that the presence of a frusto-conical container 20 in the square opening 32 engaged with the bosses 34 and forced therein by engagement of the side wall 24 with the tapered side walls 44A of the male forming members 44 and engagement of the top curl 22 with the lowermost portion of the pusher 40 will constrain the container 20 down into the bosses 34 and the square opening 32 to force the said container 20 to assume the square-round shape 20A of the present invention as illustrated in FIG. 6A.

Referring to FIG. 6A, the upper portion of the side wall 24A is shown as being square and gradually transcending from that square shape down to a completely circular intersection with the bottom web 26A which is the same shape as the web 26 initially was in the containers of FIGS. 4A–4C and 5B.

Figure 6B:
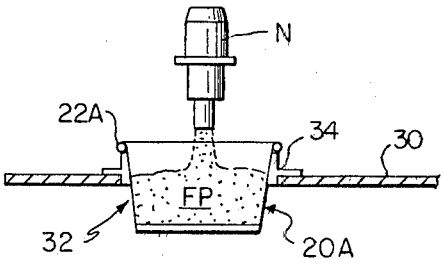
FIG. 6B is a schematic illustration of a filling station in which the now formed container is held in the die while being filled with a suitable product.

Once the container 20A has been forced into the bosses 34 and square opening 32 as into the position illustrated in FIG. 6B, in which the now square top curl 22A is resting upon the uppermost portions of the bosses 34, the container 20A is filled with a suitable food product illustrated as FP from a nozzle end or other suitable filling device.

Thus, it can be seen, that the bosses 34 comprise female die members which act in cooperation with the frusto-conical male die members or forming members 44 of the square pusher assembly 40 to form the transitional square corner portions and upper portions of the container 20A and the bosses 34 in conjunction with the square opening 32 in the plate 30 continue to maintain the container 20A in its square-round configuration until such time as a square lid 50, is placed thereon. The said square lid 50 is illustrated in top plan view in FIG. 7A as having a square peripheral bead 50A above and overlying a central web portion 50B beneath which is a dependent straight-walled skirt 50C defining the straight side portions of the three-dimensional square lid 50 as shown in FIG. 7B, in schematic cross-section.

Figure 7A:
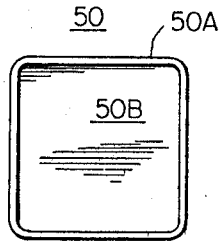
FIG. 7A is a top plan view of a square lid of the present invention.
Figure 7B:
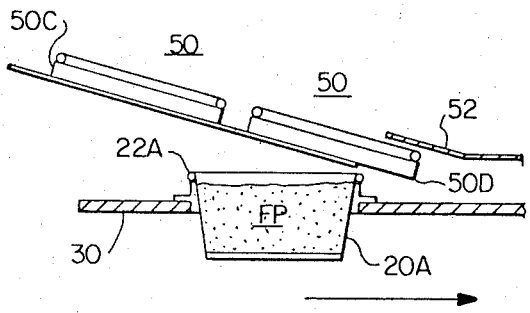
FIG. 7B is a schematic illustration of the square lids of FIG. 7A being received upon and placed on a filled square-round container of the present invention while the latter is held in the die.
Figure 8:
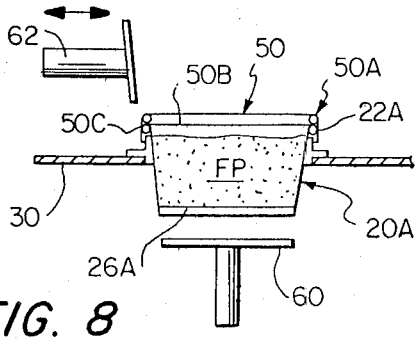
FIG. 8 is a schematic illustration of a filled and closed container ejection station with filled and closed container of the present invention illustrated in schematic cross-section.

Referring now to FIG. 7B, the formed and filled container from FIG. 6B is transferred on its particular dial segment or plate 30 to the position shown in FIG. 7B at which point one of the square lids 50 has been coin-fed into the path of the filled container 20A which is moving in the direction indicated by the arrow in the figure such that the leading edge of the now square top head 22A engages the lower interior tip 50D of the square lid 50 in its path and carries the lid 50D with it beneath a lid seating shoe or guide rail 52 to thereby place the lid 50 in a fully seated position on the container 20A as illustrated in FIG. 8, which corresponds to the next successive work station to which the dial plate segment 30 is next transferred.

When at the work station of FIG. 8, a vertical pusher 60 of a conventional type is indexed with the bottom 26A of the container 20A and when elevated by the pusher 60, the container with the square lid 50 in place is raised into the path of a horizontal discharge pusher 62 which reciprocates as illustrated by the adjacent arrow thereto to thereby force the filled and capped container 20A off the dial plate 30 and onto any suitable adjacent conveyor means such as disclosed in the above-referenced West U.S. Pat. No. 3,225,889. Also, various vertical and horizontal pusher means are illustrated in the said West patent as above-referenced.

Once the now square-round container 20A receives the square lid 50, the container is constrained by the dependent skirt 50C of that square lid 50 to maintain its square upper portion in conjunction with its round lowermost portion such that the desired shape has been imposed upon and set into the container 20A.

A plurality of such containers is then placed in a group to form a bulk package such as the bulk package 12 previously described in conjunction with FIG. 3B which for its capacity, represents an optimum minimum in volume taken up by the plurality of containers in accordance with the objects and desired results of the present invention.

It should be understood that the ROUND CONTAINERS WITH SQUARE TOPS AND METHOD AND APPARATUS FOR PRODUCING SAME of the present invention may be modified as would occur to one of ordinary skill in the art without departing from the spirit and scope of the present invention.

It is claimed:

1. A lidded container comprising:

an open mouthed container having a bottom wall of a first predetermined shape and a sidewall means extending from said bottom wall to define a said open mouth of a shape similar to that of said bottom wall; and a lid means removably disposed on said container over said open mouth to close the latter;

said lid means being of a second predetermined shape different from that of said bottom wall and said open mouth for deformably engaging said sidewall means adjacent said open mouth to constrain the latter to assume said second predetermined shape and constrain said sidewall means to assume a transitional configuration from the first predetermined shape of said bottom wall to the second predetermined shape of said lid means.

2. The lidded container of claim 1, wherein:

said first predetermined shape is a circle; and said second predetermined shape is a square.

3. A package structure characterized by minimized exterior dimensions for a given number of filled, open-mouthed containers each having a circular bottom wall and an initially frusto-conical sidewall initially defining an open container mouth of circular configuration opposite said bottom wall, said package structure comprising:

a square configured lid means on each of said filled containers deformably engaging each said sidewall and covering said container mouth therein to constrain said container mouth to assume a square configuration and said sidewall to assume a transitional configuration from said circular bottom wall to said square configured lid and container mouth;

a said given number of said filled containers in juxtaposition through their respective square configured lid means to define a rectangular grouping of said given number of containers; and a bulk package means confining said rectangular group of containers.

* * * * *